US008251045B2

(12) United States Patent
Song et al.

(10) Patent No.: US 8,251,045 B2
(45) Date of Patent: Aug. 28, 2012

(54) FUEL SUPPLYING SYSTEM OF LPI ENGINE

(75) Inventors: Ju Tae Song, Suwon (KR); Yeoun Kwan Sung, Suwon (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 365 days.

(21) Appl. No.: 12/622,334

(22) Filed: Nov. 19, 2009

(65) Prior Publication Data

US 2011/0048378 A1 Mar. 3, 2011

(30) Foreign Application Priority Data

Aug. 26, 2009 (KR) ..... 10-2009-0079451

(51) Int. Cl.
*F02M 69/02* (2006.01)

(52) U.S. Cl. ..... 123/455

(58) Field of Classification Search ..... 123/445, 123/446, 447, 457, 459
See application file for complete search history.

(56) References Cited

U.S. PATENT DOCUMENTS

| | | | | |
|---|---|---|---|---|
| 2,839,040 | A * | 6/1958 | High | 123/382 |
| 3,485,226 | A * | 12/1969 | Arendt et al. | 123/142.5 R |
| 3,901,204 | A * | 8/1975 | Jaulmes | 123/495 |
| 4,310,142 | A * | 1/1982 | Ludwig | 251/30.03 |
| 4,565,501 | A * | 1/1986 | Laurendeau et al. | 417/267 |
| 5,323,750 | A * | 6/1994 | Rotter | 123/508 |
| 6,298,832 | B1 * | 10/2001 | Yamazoe et al. | 123/514 |
| 6,491,029 | B2 * | 12/2002 | Kondou et al. | 123/509 |
| 2001/0018907 | A1 * | 9/2001 | Kondou et al. | 123/497 |
| 2011/0048376 | A1 * | 3/2011 | Song | 123/445 |
| 2011/0048377 | A1 * | 3/2011 | Song | 123/445 |

FOREIGN PATENT DOCUMENTS

| | | | |
|---|---|---|---|
| JP | 07-243364 | A | 9/1995 |
| JP | 2001-349256 | A | 12/2001 |
| KR | 10-0407501 | B1 | 12/2003 |
| KR | 10-0671357 | B1 | 1/2007 |
| KR | 10-2009-0039198 | A | 4/2009 |

* cited by examiner

*Primary Examiner* — Stephen K Cronin
*Assistant Examiner* — Arnold Castro
(74) *Attorney, Agent, or Firm* — Morgan, Lewis & Bockius LLP

(57) ABSTRACT

A fuel supplying system of an LPI engine is capable of improving performance of a fuel pump by decreasing suction pressure thereof. A fuel supplying system of an LPI engine may include a fuel tank storing fuel, a fuel pump feeding fuel supplied by the fuel tank to the engine through a fuel supplying line, and a fuel return line for returning fuel from the engine to the inside of the fuel tank. The fuel pump may be divided into a pump chamber and an operating chamber, and a vent hole is formed at a case of the fuel pump.

4 Claims, 3 Drawing Sheets

FUEL SUPPLYING SYSTEM OF LPI ENGINE

CROSS-REFERENCE TO RELATED APPLICATION

The present application claims priority of Korean Patent Application Number 10-2009-0079451 filed Aug. 26, 2009, the entire contents of which application is incorporated herein for all purposes by this reference.

BACKGROUND OF THE INVENTION

1. Field of the Invention

The present invention relates to a fuel supplying system of LPI (liquefied petroleum injected) engine, and more particularly to a fuel supplying system of LPI engine that is capable of improving performance of a fuel pump by decreasing suction pressure thereof.

2. Description of Related Art

An LPI engine includes an LPI fuel pump feed therein so as to realize stability of fuel supplying performance when forcedly feeding fuel thereto.

That is, the fuel pump is mounted inside a fuel tank, and liquid-state LPG (liquefied petroleum gas) fuel that is forcedly fed is injected by an injector.

The LPI engine is suitable for corresponding to strict emission regulations, and can improve engine starting in winter while inducing emission output reduction of the engine.

As shown in FIG. 3, a conventional fuel supplying system of LPI engine includes a fuel pump 21 mounted inside a sub-fuel tank 20 in a fuel supplying line 30 in order to feed fuel stored inside a main fuel tank 10 to the engine, and then the fuel supplied from the fuel pump 21 is injected by an injector (not shown) to a combustion chamber through the fuel supplying line 30. Unused fuel is returned through a fuel return line 40.

Herein, safety valves 50 are respectively mounted between the main fuel tank 10 and the fuel pump 21, between the fuel pump 21 and the engine in the fuel supplying line 30, and between the fuel pump 21 and the fuel tank 10 in the fuel return line 40.

The conventional fuel supplying system of an LPI engine must follow regulations on LPG vehicles.

The regulations state that an electrical cut-off valve, an overflow prevention valve, a manual cut-off valve, etc., are to be mounted at an exit of the main fuel tank 10.

That means that the main fuel tank 10 should be closed and sealed by closing the electrical cut-off valve in case of failure of starting of the engine.

Further, a safety valve should be provided so as to prevent leakage of fuel of the fuel supplying line 30 in the main fuel tank 10 in the case of a vehicle accident.

At this time, fuel should flow into the fuel pump 21 from the main fuel tank 10 without air intake.

Therefore, the safety valves should be mounted at the fuel supplying line 30 and the fuel return line 40 connecting the main fuel tank 10 and the sub-fuel tank 20, and thereby the system is complicated and manufacturing cost is increased due to duplication of the safety valves 50.

In addition, after suction back pressure generated by the fuel pump 21 is reduced by a volume of the sub-fuel tank 20, the pressure is transmitted to the main fuel tank 10, and thereby fuel intake performance is deteriorated.

Herein, because pressure of the interior of the main fuel tank 10 is high, particularly in summer, fuel intake performance is superior.

However, in winter, because pressure of the interior of the main fuel tank 10 is similar to atmospheric pressure, fuel intake performance depending on the performance of the fuel pump 21 cannot be reliable.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

The present invention has been made in an effort to provide a fuel supplying system of an LPI engine having advantages of improving performance of a fuel pump by decreasing suction pressure thereof.

A fuel supplying system of LPI engine may include a fuel tank storing fuel, a fuel pump feeding fuel supplied by the fuel tank to the engine through a fuel supplying line, and a fuel return line for returning fuel from the engine to the inside of the fuel tank. The fuel pump may be divided into a pump chamber and an operating chamber, and a vent hole is formed at a case of the fuel pump.

The fuel pump may be an external fuel pump disposed outside the fuel tank.

The fuel pump may be divided into a pump chamber and an operating chamber by a diaphragm.

The external and internal of the operating chamber are communicated each other by the vent hole.

The vent hole may reduce back pressure generated by the diaphragm moving between the pump chamber and the operating chamber.

The fuel pump may be volumetric pump.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
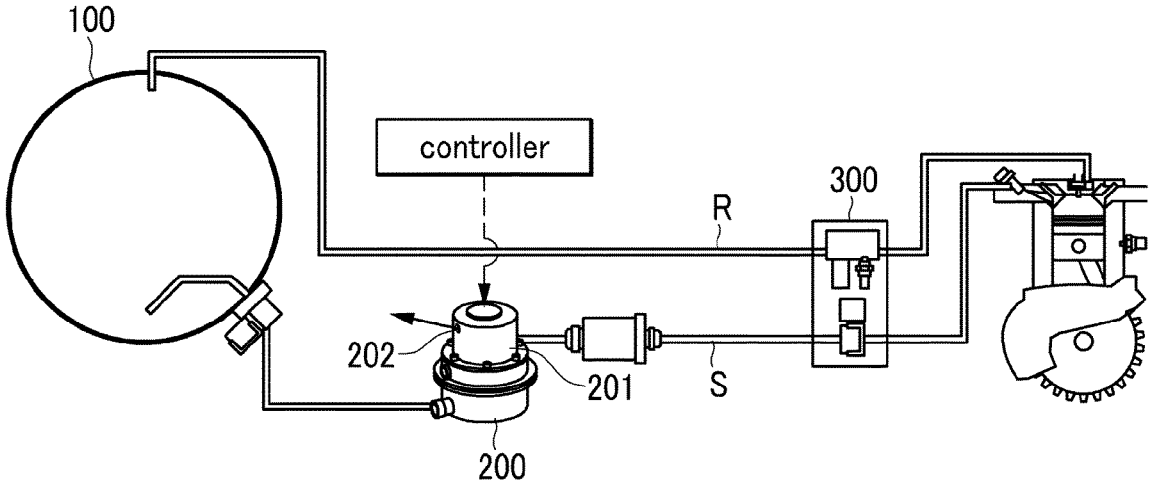
FIG. 1 is a schematic view of an exemplary fuel supplying system of LPI engine according to the present invention.

As shown in FIG. 1, a fuel supplying system of an LPI engine includes a fuel tank 100, a fuel pump 200, and a regulator unit 300.

The engine is connected to a fuel supplying line S and a fuel return line R, and liquid-state fuel stored in the fuel tank 100 is supplied to the engine by the fuel pump 200 through the regulator unit 300.

Unused liquid-state LPG fuel is returned to the fuel tank 100 through the regulator unit 300 via the fuel return line R.

The regulator unit 300 maintains supply pressure of the liquid-state fuel supplied to the engine.

In addition, a pressure sensor (not shown) detecting fuel pressure of fuel returned to the fuel tank 100 may be mounted in the fuel return line R connected to the regulator unit 300, and furthermore a pressure regulator (not shown) may be mounted therein so as to return the fuel to the fuel tank 100 only when the fuel pressure exceeds a predetermined pressure.

Although not shown in drawings, the fuel supplying system can be controlled by an ECU.

The fuel supplying system is an external type, unlike a conventional system in which a fuel pump forcedly feeds fuel to the engine by pressurizing liquid-state fuel in the fuel tank 100 in the fuel supplying line S interposed between the fuel tank 100 and the regulator unit 300.

Figure 2:
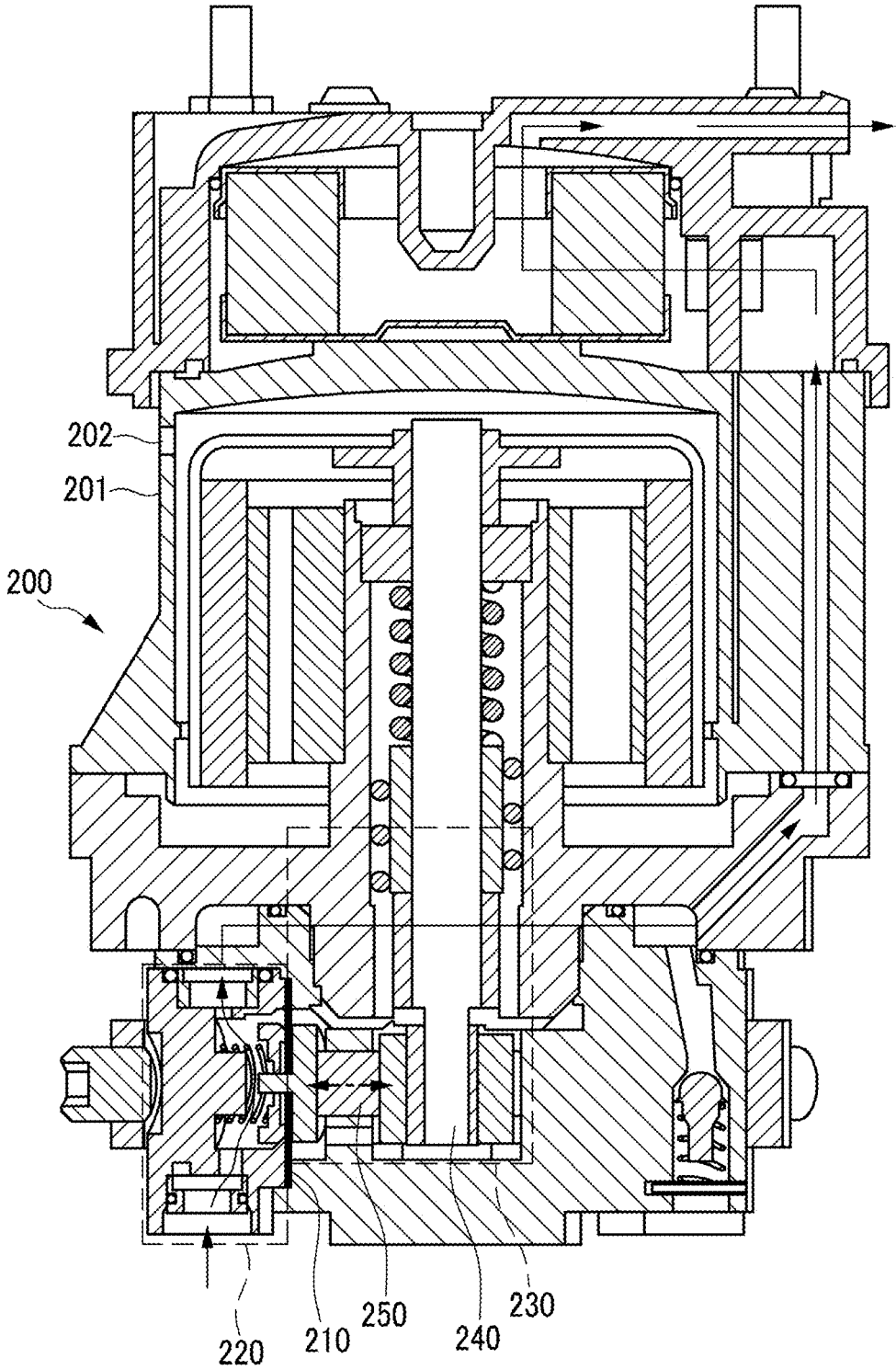
FIG. 2 is a cross-sectional view of an exemplary fuel pump applied to a fuel supplying system of an LPI engine according to the present invention.
Figure 3:
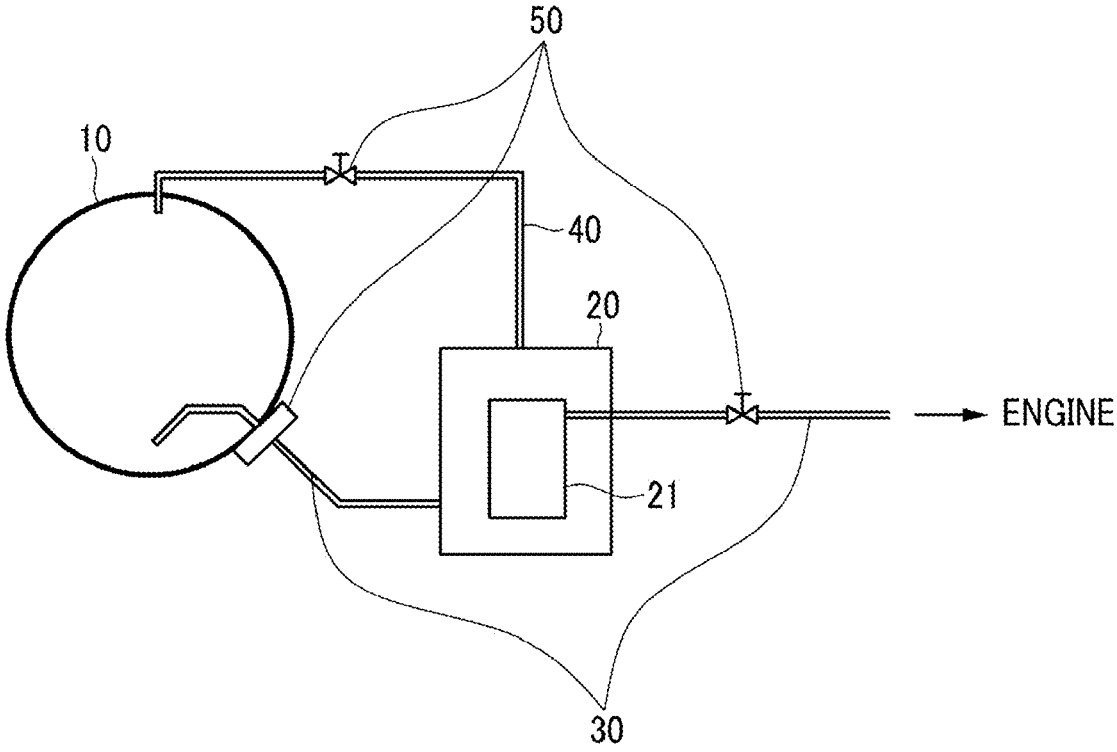
FIG. 3 is a schematic view of a conventional fuel supplying system of an LPI engine.

As shown in FIG. 2, the fuel pump 200 is divided into a fuel chamber 220 and an operating chamber 230 by a diaphragm 210.

Further, the fuel pump 200 is preferably a volumetric type only using an operating chamber 230 of a motor (not shown) and a fuel chamber 220 directly connected to the fuel supplying line S as main components.

Thus, a lower space of the fuel pump 200 is minimized.

More specifically, volume of the fuel chamber 220, as an example, may be 60 cc so as to prevent air intake under high load of the engine, and thereby a loss of back pressure of the pump is reduced.

In addition, a vent hole 202 is formed at a case 201 of the fuel pump 200 so as to communicate the operating chamber 230 to the exterior.

Herein, internal pressure and atmospheric pressure are equalized by the vent hole 202.

The fuel pump 200 is operated continuously during driving, and at this time, the fuel pump 200 pressurizes the liquid-state fuel in the fuel tank 100 to a predetermined pressure in comparison with pressure of the fuel tank 100.

For example, a pressure of 5 bar is added to the pressure of the fuel pump 100 that is 3 bar, and thereby a pressure of liquid-state fuel that is 8 bar is supplied by the fuel supplying line S.

The fuel flows to the fuel chamber 220 formed inside the fuel pump 200 by the fuel pump 200.

Although not shown in the drawings, a filter of a mesh structure can be mounted at a lower portion of the fuel pump 200 so as to improve durability thereof, and block inflow of foreign substances from the fuel tank 100 in advance.

Meanwhile, the fuel flows into the fuel chamber 220 by using rotation of an eccentric cam 240 disposed in a longitudinal direction inside the fuel pump 200.

The diaphragm 210 is moved in leftward and rightward directions in the drawings by a roller 250 that rolls and contacts between the eccentric cam 240 and the diaphragm 210.

Herein, when the diaphragm 210 is moved in the rightward direction in the drawings, the fuel flows into the fuel chamber 220, and when the diaphragm 210 is moved in the leftward direction in the drawings, the fuel that is temporarily stored in the fuel chamber 220 is forcedly fed to the fuel supplying line S in a high pressure state.

Further, in a process in which the diaphragm 210 is moved in leftward and rightward directions in the drawings, the internal pressure of the operating chamber 230 is maintained to be atmospheric pressure.

Therefore, the diaphragm 210 is operated smoothly due to a reduction of back pressure in a vacuum state, as shown above.

That is, the pressure of the fuel chamber 220 is equal to that of the fuel tank 100 in case of intake of fuel, and at that time, pressure of the operating chamber 230 is lower than that of the fuel chamber 220.

Therefore, the fuel flow is smoothly operated by as much as a difference therebetween, and thereby fuel intake to the fuel chamber 220 is performed well.

While the liquid-state fuel is supplied to the engine through the regulator unit 300, a portion of the fuel is injected by the injector and ignited, and a remaining portion thereof is returned to the fuel tank through the regulator unit 300 via the fuel return line R.

In this way, the liquid-state fuel returned through the fuel return line R is passed through the regulator unit 300 via an opened return valve (not shown), and then it is stored in the fuel tank 100.

Meanwhile, the liquid-state fuel flowing into the fuel return line R is expanded according to an increase in the temperature.

At that time, the pressure is increased to 8 bar as described above, and then the fuel flows into the fuel tank 100 again since the pressure adjuster of the regulator unit 300 and a return valve in the fuel return line R are sequentially opened.

Further, during the fuel supplying, if the fuel supplying line S between the main fuel pump 200 and the regulator unit 300 are blocked or malfunction by sludge mixed in the liquid-state fuel, pressure of the fuel supplying line S is greater than pressure of the fuel pump 200. However, a one-way check valve (not shown) prevents back flow of the supplied liquid-state fuel in order to reduce damage to the fuel pump 200.

For convenience in explanation and accurate definition in the appended claims, the terms "lower", "inside" or "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A fuel supplying system of liquefied petroleum injected (LPI) engine comprising:

a fuel tank for storing fuel;

a volumetric and external fuel pump disposed outside the fuel tank for feeding fuel supplied by the fuel tank to the engine through a fuel supplying line, wherein the fuel pump is divided into a fuel chamber and an operating chamber, and a vent hole is formed at a case of the fuel pump;

a fuel return line for returning fuel from the engine to the inside of the fuel tank;

an eccentric cam disposed inside the fuel pump, wherein rotation of the eccentric cam drives fuel into the fuel chamber; and a roller for moving a diaphragm, wherein the roller is disposed between the eccentric cam and the diaphragm and contacts the eccentric cam and the diaphragm.

2. The fuel supplying system of claim 1, wherein the fuel pump is divided into the fuel chamber and the operating chamber by the diaphragm.

3. The fuel supplying system of claim 1, wherein the external and the internal areas of the operating chamber are communicated with each other by the vent hole.

4. The fuel supplying system of claim 3, wherein the vent hole reduces back pressure generated by the diaphragm moving between the fuel chamber and the operating chamber.

* * * * *